US005179904A

United States Patent [19]

Hoyano et al.

[11] Patent Number: 5,179,904

[45] Date of Patent: Jan. 19, 1993

[54] CYCLE SEWING MACHINE

[75] Inventors: Yuhei Hoyano; Masahiko Sato, both of Tokyo, Japan

[73] Assignee: Juki Corporation, Chofu, Japan

[21] Appl. No.: 732,646

[22] Filed: Jul. 19, 1991

[30] Foreign Application Priority Data

Jul. 20, 1990 [JP] Japan ..... 2-192569

[51] Int. Cl.[5] ..... D05B 3/00

[52] U.S. Cl. ..... 112/67; 112/111

[58] Field of Search ..... 112/111, 112, 265.1, 112/66, 73, 67

[56] References Cited

U.S. PATENT DOCUMENTS

| | | | |
|---|---|---|---|
| 2,609,773 | 9/1952 | Nelson | 112/254 |
| 3,705,561 | 12/1972 | Sakawa et al. | 112/67 |
| 3,894,500 | 7/1975 | Hsiao | 112/67 X |
| 3,970,013 | 7/1976 | Hsiao | 112/67 |

*Primary Examiner*—Andrew M. Falik
*Assistant Examiner*—Paul C. Lewis
*Attorney, Agent, or Firm*—Morgan & Finnegan

[57] ABSTRACT

A cycle sewing machine comprises a main shaft and a clutch mechanism for connecting the main shaft to a driving source. The clutch mechanism has a breaking cam fixed to the main shaft. A breaking frame is movable to engage with the breaking cam to lock the main shaft at a predetermined position. A rotatable eccentric cam is synchronized with the main shaft. The machine further comprises a rocking link driven by the eccentric cam, an operative rod driven by the rocking link, a button holder driven by the operative rod to move vertically, and a thread trimming mechanism driven by the operative rod for cutting a thread. A drive control shaft rotates in synchronization with the main shaft to effect one rotation per cycle of sewing operation. The drive control shaft has a first control cam and a second control cam. A first control mechanism is driven by the first control cam for driving the clutch mechanism to connect the main shaft to the driving source, and the second control mechanism driven by the second control cam for bringing the operative rod into engagement with the rocking link and bringing the breaking lever into engagement with the breaking cam.

3 Claims, 5 Drawing Sheets (PRIOR ART)

(PRIOR ART)

CYCLE SEWING MACHINE

BACKGROUND OF THE INVENTION

1. Field of the Invention

This invention relates to a cycle sewing machine which is capable of automatically performing various operations such as disconnecting a main shaft and a drive source, lifting a button holder, and stopping the main shaft of a sewing machine from a drive source thereof, lifting a button holder, and stopping the main shaft just before completion of one sewing cycle for button sewing 2. Prior Art A sewing machine of this class, which is provided with a stop motion and control device as shown in FIG. 5 has been heretofore well known.

In such a control device, prior to a half stitch when the sewing machine stops, a roller 7 disposed on a lever 6 is rotatably energized to a control disc 5 which is rotated deceleratedly in association with the main shaft 1, and is opposed to a notch 8 in the control disc 5. The lever 6 is rotated from a position shown by a dot-and-dash line of FIG. 5 to a position shown by a solid line thereof with an energizing force or bias of a spring to the lever 6. As the lever 6 is rotated, a stop mechanism (not shown) is actuated to deceleratedly rotate the main shaft 1. At the same time, a rocking lever 3 is swung in response to rotation of an eccentric cam 2 which is secured to the main shaft 1, and an operative end 4 of the rocking lever 3 is in turn so positioned in a position shown by a solid line of FIG. 5 as to correspond to the bottom dead point of a needle.

With the rotation of the lever 6, a connecting lever 10 is moved leftwardly of FIG. 5 by a connecting link 9 integrally supported by the lever 6 to move the lower end of an operative rod 11 coupled to the connecting lever 10 from a position shown by a dot-and-dash line of FIG. 5 to a position shown by a solid line thereof. Consequently, a stepped portion 12 of the operative rod is engaged with the operative end 4 of the rocking lever 3. The rocking lever 3 is moved by a clockwise rotation of the eccentric cam 2 from a position shown by a solid line, corresponding to the bottom dead point of the needle, to the top dead point of the needle. Upon movement of the rocking lever 3, the operative rod 11 is downwardly depressed to thus arrange a button holder means laid on a bed of the sewing machine in a position away upwardly from the bed. Thereafter, the main shaft 1 is allowed to stop by the stop mechanism (not shown).

However, the conventional cycle sewing machine is designed so that the period of time when the main shaft is decelerated until the sewing machine stops corresponds to a half stitch, thereby applying a great impact to the stop mechanism, and possibly damaging the same.

Although attempts have been made to set the timing for fitting of the roller 7 into the recess 8 after one stitch when the sewing machine stops, to afford a longer speed reduction time, the conventional sewing machine involves much difficulty in decelerating the main shaft prior to one stitch since the operative rod 11 interferes with operative end 4 of the rocking lever 3 in the position shown by the dot-and-dash line of FIG. 5.

A provision for affording deceleration of the sewing machine prior to one stitch has been suggested as seen from FIG. 6, wherein like reference characters designate like or corresponding parts in FIG. 5.

The sewing machine as shown in FIG. 6 is fabricated so that the notch 8 in the control disc 5 is formed from an angle at which the disc is rotated, and which corresponds to a point just before one stitch when the sewing machine stops whereas the connecting link 9 and the connecting lever 10 are in turn connected to each other by a slot 9*a* and a step screw 10*a* inserted thereinto, the connecting lever 10 being energized by a tension spring 13 when positioned leftwardly in FIG. 6.

In this instance, prior to one stitch when the sewing machine stops, the operative rod 11 tends to abut against the operative end 4 of the rocking lever 3 in the position shown by the dot-and dash line whereas the connecting link 9 is rotated along the slot 9*a* irrespective of such abutment, to the position shown by the dot-and-dash line so that the lever 6 is rotated to a position shown by a dot-and-dash line where the roller 7 is fitted into the notch 8. This will decelerate the sewing machine before one stitch to apply an impact smaller as compared to the impact upon the stop mechanism when the sewing machines stops as in the case of FIG. 5.

Notwithstanding, the conventional sewing machine as shown in FIG. 6 is unable to obtain a full deceleration capacity when the sewing machine is operated at a high speed so that the impact upon the stop mechanism is not fully relieved. The sufficient deceleration capacity is not expected from the deceleration capacity to the extent that the sewing machine starts its operation prior to one stitch. Needless to say, it is not possible for the conventional cycle sewing machine to start deceleration further prior to one stitch. More specifically, not only commencement of the deceleration but also lift of the button holder and operation of the stop mechanism are effected by the notch 8 in the control disc 5. This results in disadvantages in that when the notch 8 is formed further prior to one stitch, operation of the button holder and the stop mechanism is not well timed, that is, too early to perform a suitable sewing and stop operation. Furthermore, the sewing machine in FIG. 6 is arranged to engage a stepped portion 12 of the operative rod 11 with the operative end 4 of the rocking lever 3 by bias of a spring 13 so that the stepped notch 12 is disengaged from the operative end 4 when any vibration is transferred to the sewing machine, causing malfunction.

OBJECT OF THE INVENTION

It is, therefore, an object of the present invention to provide a cycle sewing machine which is capable of timely connecting and disconnecting a main shaft of the sewing machine to and from a drive source in response to a speed at which the sewing machine is driven irrespective of lifting a button holder and actuating a stop mechanism, thereby obtaining a sufficient deceleration capacity and eliminating the aforementioned shortcomings.

A further object of the invention is to provide a cycle sewing machine which is capable to performing a positive operation without being affected by vibration and the like from outside.

An advantage of the present invention is that in one sewing cycle, operations such as connection and disconnection between the main shaft of the sewing machine and the drive source thereof by the clutch mechanism, thread trimming, lifting of the button holder, and actuation of the disconnecting lever are performed independently of each other by the first and second control cams whereby connection and disconnection between the main shaft and the drive source may be made irrespective of the other control and operation. For this reason, for instance, when the sewing machine is driven at a high speed, the first control cam may be so set as to disconnect the main shaft from the drive source at an early stage, so that the main shaft stops in a condition that it is fully decelerated to thus greatly minimize the impact when the sewing machine stops without exerting any influence on actuation of not only the button holder but also the other parts and members.

In brief, the present invention comprises a main shaft of a sewing machine; a disconnecting frame for locking a main shaft of a sewing machine and fixed to a second rotatable shaft; an operative rod for actuating a thread trimming mechanism and a button holder; the operative rod being fixed to a second operative lever secured to the second rotatable shaft, the second operative lever being controlled by a second control cam mounted on a rotary shaft rotatable during one sewing cycle; a first operative lever fixed to a first rotatable shaft, the first operative lever being controlled by a first control cam secured to the rotary shaft; and a clutch mechanism controllable by operation of the first operative lever.

In the cycle sewing machine, the first and second rotatable shafts may be in a double structure such as a cannon rotatable to each other.

PREFERRED EMBODIMENT OF THE INVENTION

The present invention will be now described by referring to the accompanying drawings, FIG. 1 through FIG. 4 in which the preferred embodiment of the invention is illustrated.

Figure 1:
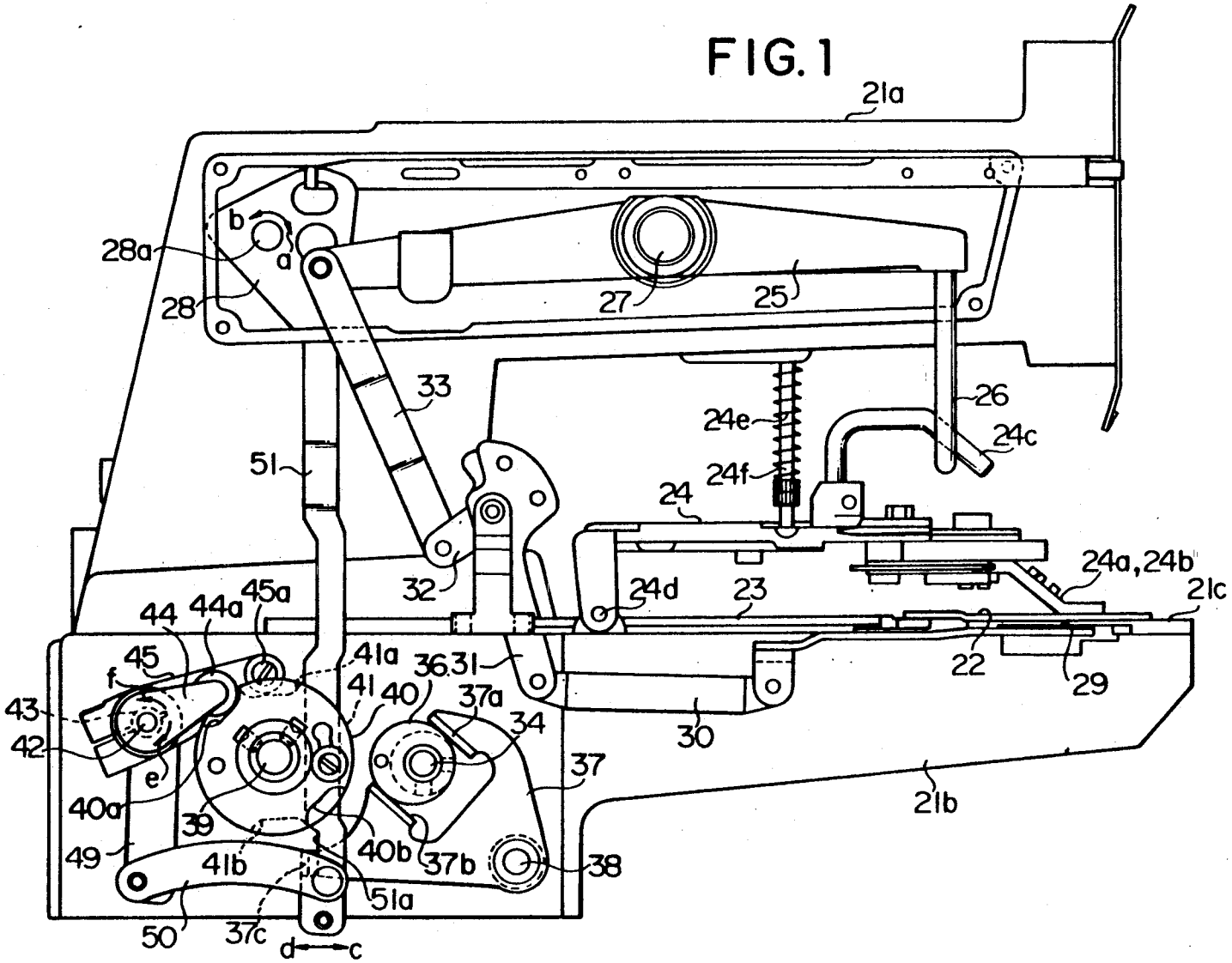
FIG. 1 is a side elevation showing a cycle sewing machine embodying the present invention.

As shown in FIG. 1, numeral 21*a* is an arm of the sewing machine having a needle and the like (not shown). Numeral 21*b* is a bed of the sewing machine having a feed plate 22 and the like on the top thereof. Numeral 23 is a carriage which is slidably moved over the bed 21*b*. Numeral 24 is a button holder which is rotatably supported by a pivot shaft 24*d* and which is normally and downwardly urged by a pressure rod 24*f* that is downwardly urged by a spring 24*e*. The button holder 24 is disposed opposite to the feed plate 22 and is provided at its one end (rightwardly of FIG. 1) with a pair of button clamp legs 24*a*, 24*b* which hold the periphery of a button therebetween. The button holder 24 is also formed on its top with a hook 24*c*. A lift lever 25 is rotatably supported on the arm 21*a* by a shaft 27 mounted at the center thereof. The lift lever 25 includes one end connected to a rotary link 28 rotatably supported by a shaft 28*a* on the arm 21*a* and the other end from which a push member 26 is downwardly extended. An operative rod 51 is connected at its upper end to the rotary link 28. When the rotary link 28 is rotated in the direction of an arrow a by lowering the operative rod 51, the push member 26 of the lift lever 25 upwardly pulls the hook 24*c* of the button holder 24 to upwardly keep the button clamp legs 24*a*, 24*b* away from the feed plate 22. A thread trimming knife 29 is disposed on the underside of a needle or thread plate 21*c* and connected to the rotary link 28 by links 30, 31, 32 and 33 which act in association therewith. The knife 29 is moved horizontally by rotation of the rotary link 28 in the direction of the arrow a to trim a thread extending from a workpiece to a looper between the knife and a stationary blade (not shown). A thread trimming mechanism is composed of parts or members 29, 30, 31, 32 and 33.

Figure 3:
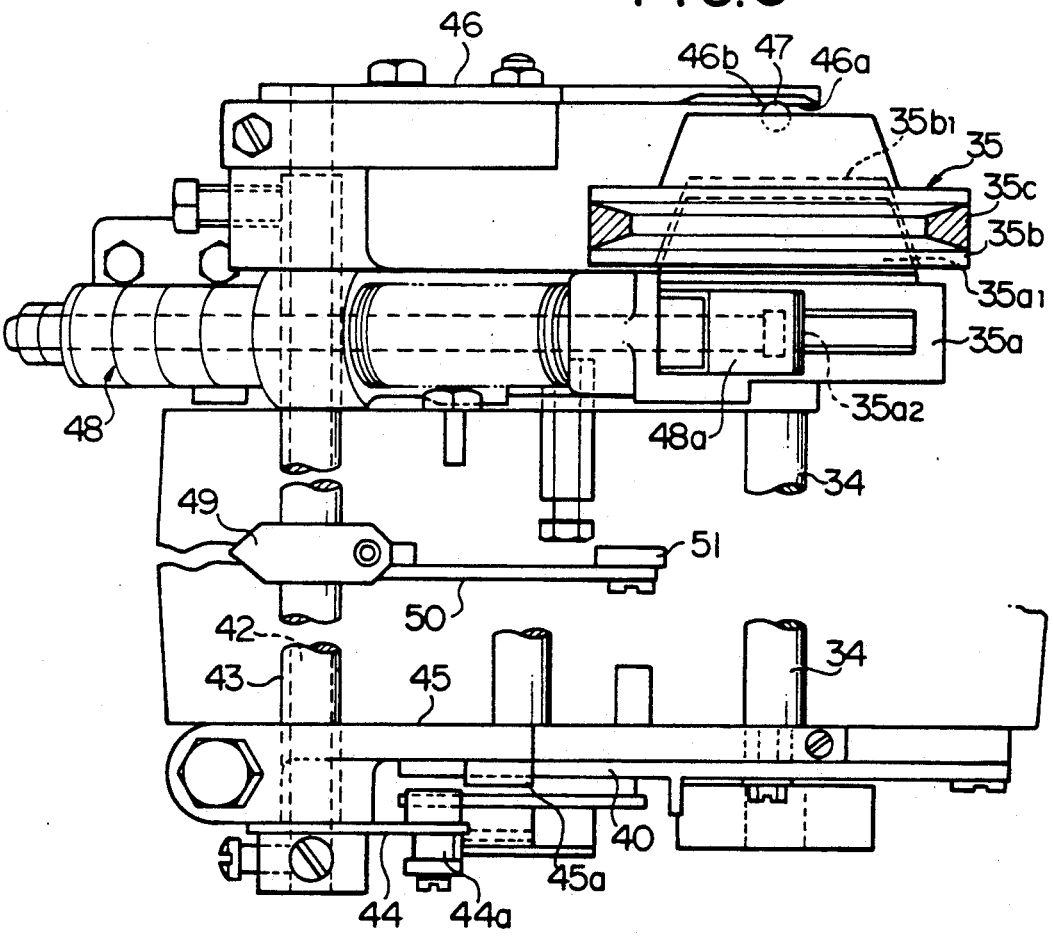
FIG. 3 is a plan view of the main part shown in FIG. 2.

A main shaft 34 of the sewing machine is supported on the bed 21*b* and is adapted to receive a turning force from a drive source (not shown) such as a sewing machine motor or the like through a clutch mechanism 35 as shown in FIG. 3. More specifically, the clutch mechanism 35 comprises a disconnecting pulley 35*a*, and a drive pulley 35*b*. The disconnecting pulley 35*a* includes a truncated conical brake 35*a*1 fixed to the main shaft of the sewing machine. The drive pulley 35*b* is adapted for rotation to the main shaft 34 and for axial movement and is formed with a concave surface 53*b*1 which can be engaged with and disengaged from the brake 35*a*1. The drive pulley 35*b* is coupled to the drive source (not shown) by a belt 35*c* trained on the periphery thereof. The turning effort of the motor is transferred to the main shaft 34 by engaging the brake 35*a*1 with the drive pulley 35*b*.

An eccentric cam 36, as shown in FIG. 1, is fixed to the main shaft 34 and is adapted to have its periphery contacted with a pair of contact surfaces 37*a*, 37*b* of fork ends of a rocking link 37. The rocking link 37 is adapted for one reciprocal swivel movement about a shaft 38 when the eccentric cam 36 and the main shaft 34 make one revolution, thereby reciprocally moving up and down an engageable portion 37*c* formed at one end of the link 37.

A drive control shaft 39 is mounted in parallel with the main shaft 34 and interlocked therewith by an interlocking mechanism (not shown). The drive control shaft 39 is adapted for one revolution by rotating the main shaft 34 for one sewing cycle. A first control cam 40 is secured to the drive control shaft 39 and is provided on its periphery with first notches 40*a*, 40*b* (first operative cam portion) which are formed to be 180° away from each other on the circumference of the cam. The notches 40*a*, 40*b* are provided beyond the range of the angle at which the control cam 40 is rotated for one stitch (the range of the angle at which the drive control shaft 39 is rotated to correspond to one revolution of the main shaft 34). For example, the notches are formed within the range of the angle at which the control cam 40 is rotated for 1.5 (one and one-half) stitch. A second control cam 41 is also fixed to the drive control shaft 39 and is provided on its periphery with second notches 41*a*, 41*b* (second operative cam portion) which are formed to be 180° away from each other on the circumference of the second cam.

Figure 2:
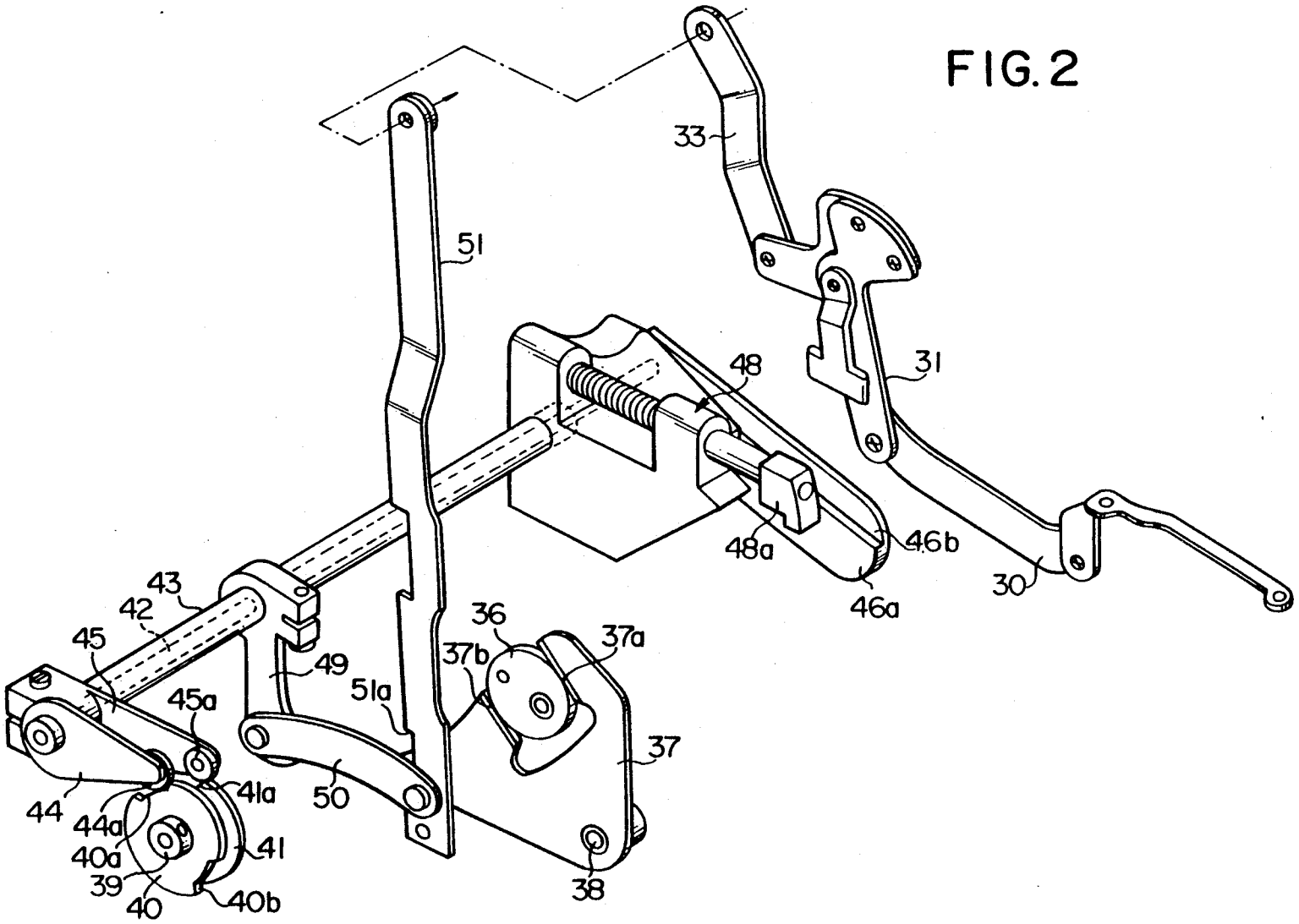
FIG. 2 is an exploded perspective view showing the main part of the embodiment of the invention.

A second rotatable shaft 43, in a hollow cylindrical form, is rotatably supported on the bed 21*b* and arranged in parallel with the drive control shaft 39. A first rotatable shaft 42 is rotatably fitted into the hollow shaft 43 and forms a double shaft spindle, such as a cannon, with the second rotatable shaft 43 (FIG. 2). First and second operative levers 44, 45 are mounted on the first and second rotatable shaft 42, 43, respectively and are pressed against the first and second control cams 40, 41 respectively through rollers 44*a* and 45*a*. Each of the operative levers 44, 45 are normally urged against the first and second control cams 40, 41 by energizer means (not shown).

A clutch control lever 46, shown in FIG. 3, is attached to the first rotatable shaft 42 and provided at one end with two types of cams 46*a*, 46*b* of different thickness, which are adapted to selectively receive a ball member 47 disposed on one side of the drive pulley 35*b* to abut against either one of the cams (FIG. 3). The thicker cam 46*a* when allowed to contact with the ball member 47 moves the drive pulley 35*b* toward the disconnecting cam 35*a* to join the former to the main shaft, thereby coupling the main shaft 34 to the drive source of the sewing machine. When the thin cam 46*b* is in contact with the ball member 47, the drive pulley 35*b* is kept away from the brake 35*a*1 by energizer means (not shown) to disconnect the main shaft 34 from the drive source.

Figure 4:
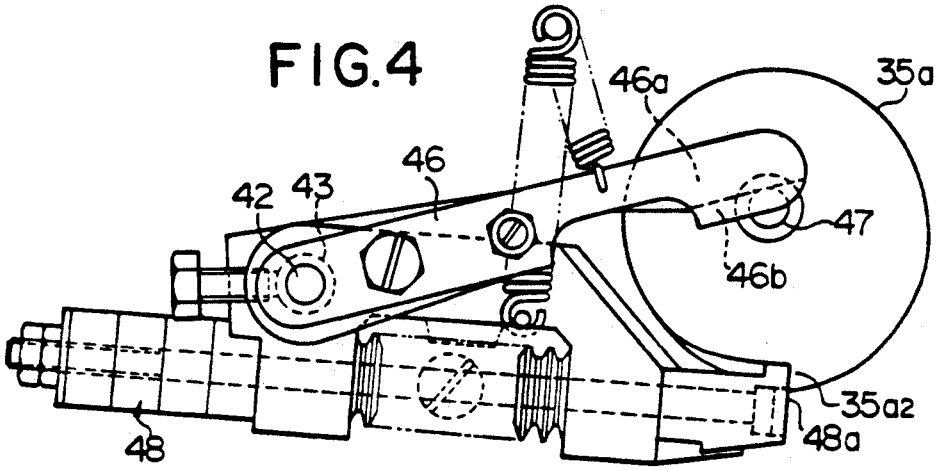
FIG. 4 is a plan view of the main part shown in FIG. 3.
Figure 5:
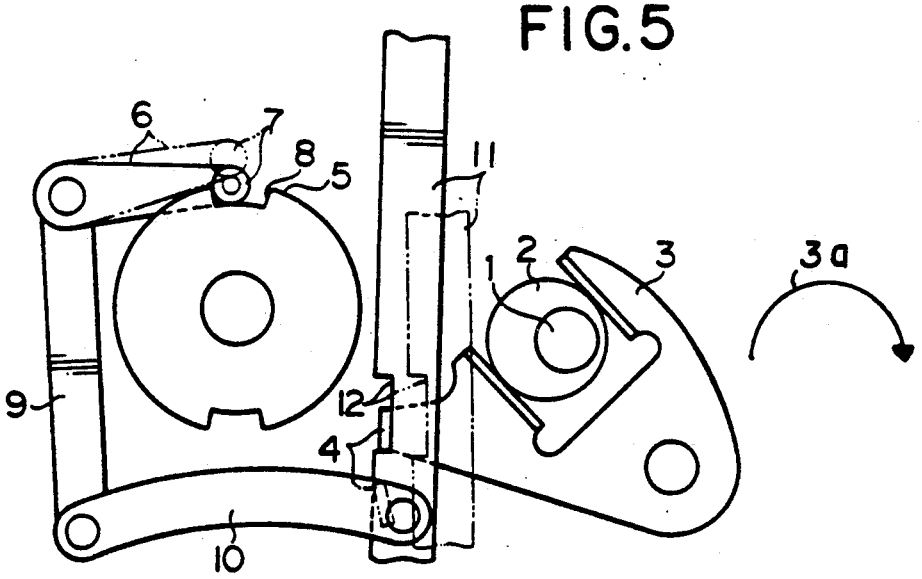
FIG. 5 is a side view of a conventional cycle sewing machine.
Figure 6:
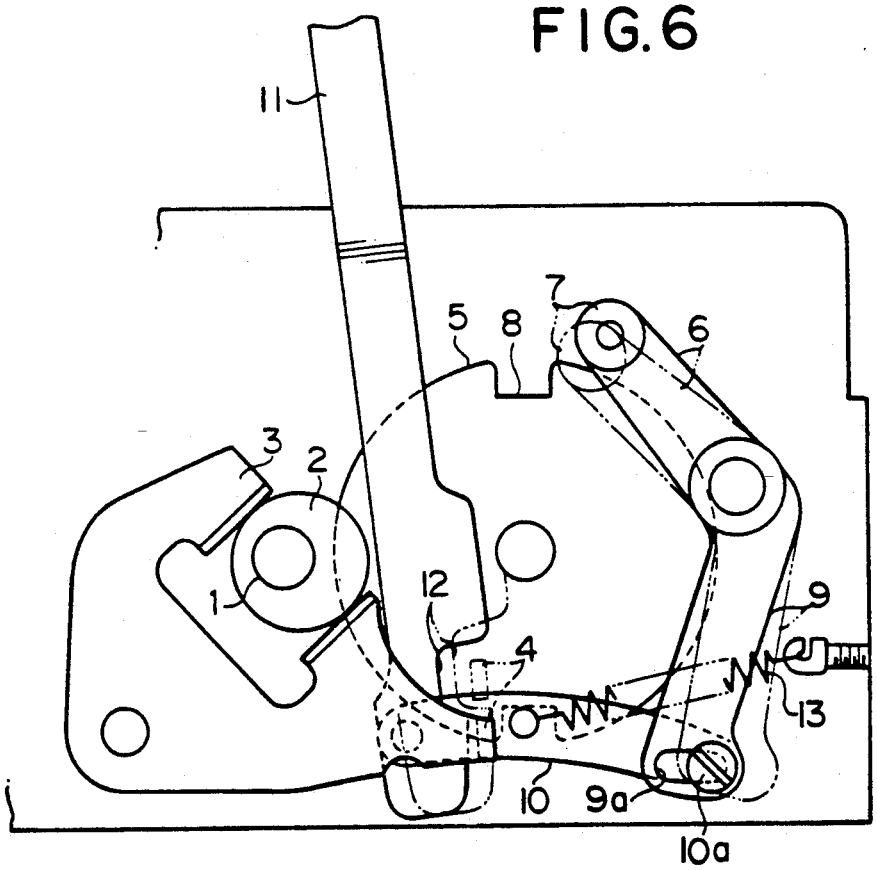
FIG. 6 is a side elevation of the main part of another conventional cycle sewing machine.

A breaking or disconnecting lever 48 is mounted on the first rotatable shaft 42 and has its forward end with an abutment 48*a*, shown in FIG. 4, which is adapted to face a stop end 35*a*2 formed on the periphery of the breaking cam 35*a* upon rotation of the disconnecting lever 48.

A connecting link 49 has one end which is mounted to the second rotatable shaft 43 and the other end to which the lower end of the operative rod 51 is journalled by a connecting link 50. By swivel movement of the second rotatable shaft 43 and the connecting link 49, the operative rod 51 is swung in opposite directions of c, d of FIG. 1 to have it engaged with and disengaged from the engageable portion 37*c* of the rocking link 37.

In operation, when the rollers 44*a*, 45*a* of the operative levers 44, 45 are in contact with the peripheries of the control cams 40, 41, the thicker cam 46*a* of the clutch control lever 46 is brought into contact with the ball member 47 to maintain interconnection between the main shaft 34 and the drive source of the sewing machine. On the other hand, the disconnecting lever 48 is in a position where it is out of contact with the stop end 35*a*2 of the disconnecting cam 35*a* while the sewing machine is in a drive condition. During the period of time when the sewing machine is driven, the connecting links 49 and 50 keep the first operative rod 51 moved in the direction of c whereas an engageable portion 51*a* of the operative rod 51 is in disengagement from the engageable portion 37*c* of the rocking link 37.

Now a sewing process is carried out up to 1.5 (one and one-half) stitch when the sewing machine stops, the roller 44*a* of the first operative lever 44 is fitted into the notch 40*a* in the first control cam 40 to rotate the first rotatable shaft 42 in the direction of an arrow e of FIG. 1. This will rotate the clutch control lever 46 in the same direction to change cam means in contact with the ball member 47 from the thicker cam 46*a* to the thin cam 46*b*. Consequently, the drive pulley 35*b* is away from the brake 35*a*1 to disconnect the main shaft 34 from the drive source, thereby decelerating rotation of the main shaft 34. The roller 45*a* of the second operative lever 45 is fitted into the notch 41*a* in the second control cam 41, subsequent to one stitch after the first operative lever 44 has been inserted into the notch 40*a*, that is, prior to half stitch when the sewing machine stops, to rotate the second rotatable shaft 43 in the direction of an arrow e of FIG. 1. This will rotate the connecting link 49 in the same direction to allow the connecting link 50 to move the operative rod 51 in the direction of the arrow d of FIG. 1. As a result, the engageable portion 51*a* of the operative rod 51 engages with the engageable portion 37*c* of the rocking link 37. In this connection, it is noted that prior to one half stitch when the sewing machine stops, the engageable portion 37*c* of the rocking link 37 is raised in response to the upper dead point of the needle so that the engageable portion 37*c* is not allowed to interfere with parts other than the engageable portion 51*a* of the operative rod 51 to positively engage the engageable portion 51*a* with the engageable portion 37*c*. At the same time, the disconnecting lever 48 is rotated toward the disconnecting cam 35 to thus rotate the engageable portion 48*a* to a position where it abuts against the stop end 35*a*2 of the disconnecting cam 35.

Thereafter, for remaining or residual half stitch, the engageable portion 37*c* of the rocking link 37 is lowered as the needle is lowered to depress the operative rod 51 which is engaged with the rocking link, thereby rotating the rotary link 28 in the direction of the arrow a.

By rotation of the rotary link 28, the thread trimming knife 29 is actuated by means of the links 33, 32, 31 and 30 to trim the thread between the hook and the workpiece whereas the lift member 26 of the force lever 25 is moved upwardly to pull up the hook 24*c* of the button holder 24 to keep the button clamp legs 24*a*, 24*b* away from the feed plate, thereby upwardly moving the workpiece as well as the button.

When the main shaft 34 is rotated for the remaining half stitch, the stop end 35*a* of the disconnecting cam 35 abuts against the engageable portion 48*a* of the disconnecting lever 48 to prevent the main shaft from rotating. At this moment, the main shaft 34 is disconnected from the drive source prior to one and one half stitch and is thus fully decelerated to minimize impact when the engageable portion 48*a* is brought into contact with the stop end 35*a*2 to avoid damage and the like on the apparatus.

Although the first and second embodiments have been described by way of example that the first and second operative links 44, 45 are fitted into the notches 40*a*, 41*a*, respectively in the first and second control cams 40, 41, operations such as thread trimming, upward movement of the button holder, and steppage of the main shaft may be performed even when the operative links 44, 45 are inserted into the other recess 40*b*, 41*b*. Such operations may be performed at every half cycle in sewing four buttons according to the instant embodiment. In contrast, when one sewing cycle is repeatedly made, the notches 40*b*, 41*b* are provided with arcuate members (not shown) to prevent the operative levers 44, 45 from being operated.

Although the aforementioned embodiments have been also described by way of example that the notches 40*a*, 40*b* in the first control cam 40 are set prior to one and one half stitch before the sewing machine stops, the notches 40*a*, 40*b* may be dimensioned more than those in the instant embodiments and vary in the dimension according to a speed at which the main shaft is rotated.

According to the aforementioned embodiment, the first and second rotatable shafts are fabricated in a double structure such as a cannon. The rotatable shafts may be arranged in a different axis.

As set forth hereinbefore, the cycle sewing machine is arranged so that operations such as connection and disconnection between the main shaft and the drive source by the clutch mechanism, thread trimming, lifting of the button holder, and actuation of the disconnecting frame are performed independently of each other by the first and second control cams whereby connection and disconnection between the main shaft and the drive source may be made irrespective of the other control and operation. For this reason, if the first control cam may be so set as to disconnect the main shaft from the drive source at an early stage, the main shaft may stop in a condition that the main shaft is fully decelerated to thus greatly minimize impact when the sewing machine stops.

While the embodiments of the present invention, as herein disclosed, constitute a preferred from, it is to be understood that other forms might be adopted.

We claim:

1. A cycle sewing machine comprising:

a main shaft;

clutch means for connecting said main shaft to a driving source, said clutch means having a breaking cam fixed to said main shaft;

a breaking lever movable to engage with said breaking cam to lock said main shaft at a predetermined position;

an eccentric cam rotatable in synchronization with said main shaft;

a rocking link driven by said eccentric cam;

an operative rod selectively moved into engagement with said rocking link and driven by said rocking link;

a mirror link driven by said operative rod to rotate in a clockwise and in a counterclockwise direction;

a lift lever connected at one end thereof to said rotary link to move in response to said clockwise and counterclockwise rotary link rotation;

a button holder connected to the other end of said lift lever to enable said button holder to be lifted thereby;

a plurality of links coupled to said rotary link for movement in response to said clockwise and counterclockwise rotary link rotation;

a thread trimming mechanism driven by said rotary link and said plurality of links coupled to said rotary link which act in association therewith;

a drive control shaft rotatable in synchronization with said main shaft to effect one rotation per a cycle of a sewing operation, said drive control shaft having a first control cam and a second control cam;

first control means driven by said first control cam for driving said clutch means to connect said main shaft to said driving source; and second control means driven by said second control cam whereby said second control cam brings said operative rod into said selective engagement with said rocking link and brings said breaking lever into engagement with said breaking cam.

2. A cycle sewing machine according to claim 1 wherein said first control cam includes an operative cam portion;

said first control means including a first rotatable shaft rotatably supported on a sewing machine frame, and a first operation lever fixed to said first rotatable shaft for engaging with said first control cam, said first operation lever rotating said first rotatable shaft when engaged with said operative cam portion of said first control cam;

said second control cam includes an operative cam portion;

said second control means including a second rotatable shaft rotatably supported on a sewing machine frame, said second rotatable shaft being fixed to said breaking lever; and a second operation lever fixed to said second rotatable shaft for engaging with said second control cam, said second operation lever rotating said second rotatable shaft when engaged with said operative cam portion of said second control cam.

3. A cycle sewing machine according to claim 2 wherein said first and second rotatable shafts, have a common axis to form a cannon.

* * * * *

UNITED STATES PATENT AND TRADEMARK OFFICE

CERTIFICATE OF CORRECTION

PATENT NO. : 5,179,904

DATED : January 19, 1993

INVENTOR(S) : Yuhei Hoyano, et al.

It is certified that error appears in the above-identified patent and that said Letters Patent is hereby corrected as shown below:

Column 7, line 31, change "mirror" to --rotary--.

Signed and Sealed this

Second Day of November, 1998

*Attest:*

Bruce Lehman

BRUCE LEHMAN

*Attesting Officer*

*Commissioner of Patents and Trademarks*